US009981371B2

(12) United States Patent
Comarmond

(10) Patent No.: US 9,981,371 B2
(45) Date of Patent: May 29, 2018

(54) METHOD FOR SWITCHING THE STRIKING STROKE OF A STRIKING PISTON OF A PERCUSSION DEVICE

(71) Applicant: MONTABERT, Saint-priest (FR)

(72) Inventor: Jean-Sylvain Comarmond, Vourles (FR)

(73) Assignee: MONTABERT, Saint-priest (FR)

( * ) Notice: Subject to any disclaimer, the term of this patent is extended or adjusted under 35 U.S.C. 154(b) by 1025 days.

(21) Appl. No.: 14/364,011

(22) PCT Filed: Dec. 3, 2012

(86) PCT No.: PCT/FR2012/052775

§ 371 (c)(1),
(2) Date: Jun. 9, 2014

(87) PCT Pub. No.: WO2013/083903

PCT Pub. Date: Jun. 13, 2013

(65) Prior Publication Data

US 2014/0326473 A1 Nov. 6, 2014

(30) Foreign Application Priority Data

Dec. 9, 2011 (FR) ..... 11 61366

(51) Int. Cl.
*B25D 9/26* (2006.01)
*B25D 9/14* (2006.01)
*B25D 9/18* (2006.01)

(52) U.S. Cl.
CPC ..... *B25D 9/26* (2013.01); *B25D 9/145* (2013.01); *B25D 9/18* (2013.01)

(58) Field of Classification Search
CPC ..... B25D 9/26; B25D 9/145; B25D 9/18
See application file for complete search history.

(56) References Cited

U.S. PATENT DOCUMENTS

| | | | | |
|---|---|---|---|---|
| 4,413,687 A | | 11/1983 | Eklof | |
| 4,800,797 A | | 1/1989 | Comarmond | |
| 4,899,836 A | | 2/1990 | Venot | |
| 5,134,989 A | | 8/1992 | Akahane | |
| 5,653,295 A | * | 8/1997 | Juvonen | B25D 9/145 173/207 |

(Continued)

FOREIGN PATENT DOCUMENTS

| | | | | |
|---|---|---|---|---|
| DE | 4019016 A1 | * | 6/1991 | B25D 9/26 |
| EP | 0214064 A1 | | 3/1987 | |

(Continued)

OTHER PUBLICATIONS

International Search Report for corresponding International PCT Application No. PCT/FR2012/052775, dated Feb. 22, 2013.

*Primary Examiner* — Thomas E Lazo
(74) *Attorney, Agent, or Firm* — Workman Nydegger

(57) ABSTRACT

A switching method includes starting up a percussion device in acting on a control device arranged to vary the striking stroke of the striking piston between a short striking stroke and a long striking stroke. The percussion device is forced to operate on a short striking stroke for a predetermined period of time from the starting up of the device, and in acting on the control device so as to allow the percussion device to operate on a long striking stroke, after the expiry of the predetermined period of time.

13 Claims, 5 Drawing Sheets

(56) References Cited

U.S. PATENT DOCUMENTS

| | | | | | |
|---|---|---|---|---|---|
| 5,667,022 | A * | 9/1997 | Gude | B25D 9/145 | 173/105 |
| 5,669,281 | A * | 9/1997 | Comarmond | B25D 9/26 | 91/245 |
| 6,672,403 | B2 * | 1/2004 | Ahr | B25D 9/265 | 173/1 |
| 8,151,900 | B2 | 4/2012 | Piras | | |
| 2009/0250234 | A1 | 10/2009 | Piras | | |

FOREIGN PATENT DOCUMENTS

| | | | |
|---|---|---|---|
| EP | 0256955 | A1 | 2/1988 |
| EP | 0715932 | A1 | 6/1996 |
| EP | 0778110 | A2 | 6/1997 |
| FR | 2902684 | A1 | 12/2007 |
| WO | 2012026571 | A1 | 3/2012 |

* cited by examiner

METHOD FOR SWITCHING THE STRIKING STROKE OF A STRIKING PISTON OF A PERCUSSION DEVICE

BACKGROUND

The object of the present invention is a method for switching the striking stroke of a striking piston of a percussion device actuated by a pressurized incompressible fluid, and a percussion device for implementing this method.

Percussion devices actuated by a pressurized incompressible fluid are supplied with fluid in such a way that the resultant of the hydraulic forces applying successively on the striking piston moves the latter alternately in one direction then the other.

In such devices, the striking piston moves alternately inside a cylinder in which at least two antagonistic chambers with different sections are arranged. The one, constantly supplied with pressurized fluid, called lower chamber, ensures the upstroke of the striking piston, and the other one, antagonistic, with a larger section, called upper chamber, is alternately supplied with pressurized fluid during the stroke of the striking piston and connected to the low-pressure return circuit of the device during the upstroke of the striking piston. It is also known that, if the tool is not properly pressed on the material to be destroyed or if the material is too soft, the device will tend to perform "empty blows" on the tool, these blows are very destructive to the tool and the device itself. The percussion devices are thus generally provided also with a chamber, called brake chamber, which is used to hydraulically stop the stroke of the striking piston when the tool is not pressed on the material to be destroyed. The presence of such a brake chamber allows to avoid direct impacts between the striking piston and the cylinder. This brake chamber can be advantageously arranged in the extension of the lower chamber.

It is known that for a given power of the device, expressed by the product of the value of the striking frequency and the value of the energy per blow, when the device works on a homogeneous firm ground, it is preferable to favor energy per blow over the frequency to obtain optimal productivity.

On the contrary, for the device to work on a soft ground, it is advantageous to reduce the energy per blow, and consequently increase the striking frequency.

The energy per blow is the kinetic energy given to the striking piston, and depends on the striking stroke and on the supply pressure. To adjust the striking frequency and the energy per blow suited to the hardness of a given ground, there are several known solutions described in documents EP 0 214 064, EP 0 256 955, EP 0 715 932 and FR 2 902 684 on behalf of the Applicant.

The document EP 0 214 064 describes a device which allows to obtain automatic adjustment of the percussion parameters, thanks to the presence in the cylinder of the device of a channel supplied with fluid according to the position of the striking piston after the impact and the possible rebound of the latter on the tool.

The document EP 0 256 955 describes a device which allows to obtain the same result, depending on the pressure variations in the upper chamber and the lower chamber, consecutive to the effect of the rebound of the striking piston on the tool, thanks to the presence of a hydraulic element which is sensitive to these variations.

The document EP 0 715 932 describes a simplified system that can equip low and medium power devices. This system consists, during the phase of the rebound of the striking piston consecutive to the impact, in determining the possible existence of an instantaneous flow rate of a fluid flowing from the upper chamber to the supply circuit, and using this signal to control the percussion parameters, such as the striking pressure or the frequency of the device.

The document FR 2 902 684 describes a percussion device in which, when the striking piston penetrates the brake chamber, pressurizing the fluid contained in the brake chamber allows to control a slide acting on the stroke of the striking piston, thanks to a channel opening into the brake chamber.

When the devices described in the aforementioned documents are used in operating sequences with very short operation interruptions and in firm ground, it is not uncommon that, at start-up of the device, the impact energy applied to the striking piston is high, which can cause "empty blows" on the tool, and excessive fatigue of the latter and of the keys holding it.

SUMMARY

The present invention aims to overcome these drawbacks.

The technical problem underlying the invention therefore consists in providing a method and a device for the implementation thereof, allowing to preserve the integrity of the device, and more particularly the integrity of the tool and the keys holding it.

To this end, the present invention relates to a method for switching the striking stroke of a striking piston of a percussion device, actuated by a pressurized in compressible fluid, between a short striking stroke and a long striking stroke, and conversely, the striking piston being alternately movable inside a cylinder of a body of the percussion device and being arranged to strike a tool during each operating cycle, the percussion device comprising a control device arranged to vary the striking stroke of the striking piston between the short and long striking strokes, the switching method being characterized in that it comprises the steps of:

starting up the percussion device, acting on the control device so as to force the percussion device to operate on a short striking stroke for a predetermined period of time from the starting up of the device, and acting on the control device so as to allow the percussion device to operate on a long striking stroke, after the expiry of the predetermined period of time.

Thus, the method according to the invention ensures a percussion device start-up in a low-impact-energy operating mode so as to limit empty blows on the tool, then, after a predetermined period of time, for example a few seconds, allows a maximum impact-energy operating mode. The method according to the invention thus allows to preserve the integrity of the tool and of the keys holding it, and generally the integrity of the percussion device.

Preferably, the striking piston and the cylinder delimit at least a lower chamber continuously connected to a high-pressure fluid supply circuit and an upper chamber put in relation alternately with the high-pressure fluid supply circuit and a low-pressure return circuit by the action of a distributor connected to the control device, and the control device comprises a first control channel connected to the distributor, and a second control channel opening into the cylinder of the striking piston and arranged to be put in communication with the lower chamber during the upstroke of the striking piston, the step of acting on the control device performed during the predetermined period of time consisting in acting on the control device so as to maintain communication between the first and second control channels, and the step of acting on the control device performed at the expiry of the predetermined period of time consisting in acting on the control device so as to isolate the first and second control channels.

According to one embodiment of the invention, the step of acting on the control device performed after the expiry of the predetermined period of time comprises a step consisting in supplying the control device with high-pressure fluid via a connecting channel provided with a calibrated orifice, so as to move a slide which the control device includes. The connecting channel is, for example, connected to the lower chamber.

The present invention further relates to a percussion device actuated by a pressurized incompressible fluid, including:

a striking piston mounted to move alternately inside a cylinder arranged in a body of the percussion device, and arranged to strike a tool during each operating cycle of the percussion device, the striking piston and the cylinder delimiting a lower chamber continuously connected to a high-pressure fluid supply circuit and an upper chamber, a distributor arranged to put the upper chamber in relation alternately with the high-pressure fluid supply circuit and a low-pressure return circuit, a control device arranged to vary the striking stroke of the striking piston between a short striking stroke and a long striking stroke, and conversely, the control device comprising a cylinder, a first control channel opening into the cylinder of the control device and connected to the distributor, and a second control channel opening into the cylinder of the control device and into the cylinder of the striking piston, the second control channel being arranged to be put in communication with the lower chamber during the upstroke of the striking piston, the control device further comprising a slide mounted to move into the cylinder of the control device between a first position in which the slide puts the first and second control channels in communication, and a second position in which the slide isolates the first and second control channels, the slide and the cylinder of the control device delimiting at least one chamber in which a first face of the slide is situated, and a second chamber in which a second face of the slide opposite the first face is situated, characterized in that the percussion device comprises:

return means arranged to cooperate with the first face of the slide of the control device so as to bias the slide to its first position, and a first connecting channel arranged to connect the second chamber of the control device to the high-pressure fluid supply circuit, the first connecting channel being provided with a calibrated orifice.

Thus, at start-up of the percussion device, the amount of fluid coming from the high-pressure fluid supply circuit and passing through the calibrated orifice is insufficient to move the slide in its second position against the action of the return means. The slide is therefore maintained in its first position, and the first and second control channels are connected to each other. The result is a percussion device operating on a short striking stroke of the striking piston.

At the expiry of the predetermined period of time, for example in the order of few seconds, the amount of fluid passing through the calibrated orifice is sufficient to move the slide in its second position against the action of the return means. This movement of the slide causes the isolation of the first and second control channels, and thereby the control of the operation of the percussion device on a long striking stroke of the striking piston.

The percussion device according to the invention allows thus, at start-up, to ensure a low impact-energy operating mode, which limits empty blows on the tool, and thus preserves the integrity of the latter.

The return means are advantageously housed in the first chamber of the control device.

According to one embodiment of the invention, the first connecting channel is arranged to connect the second chamber of the control device to the lower chamber. Preferably, the first connecting channel opens, on one hand, into the lower chamber and, on the other hand, into the second chamber of the control device. The first connecting channel opens for example into a first end wall of the cylinder of the control device.

The slide of the control device advantageously comprises an annular groove arranged to put the first and second channels in communication when the slide is in its first position.

According to one embodiment of the invention, the first control channel opens also into the cylinder of the striking piston, and the second control channel opens into the cylinder of the striking piston between the first control channel and the lower chamber.

According to one embodiment of the invention, the first connecting channel is continuously connected to the high-pressure fluid supply circuit.

According to a first alternative embodiment of the invention, the percussion device comprises a second connecting channel provided with a calibrated orifice, the second connecting channel being continuously connected to the low-pressure return circuit and opening into the first chamber of the control device.

According to this first alternative embodiment of the invention, the percussion device advantageously comprises a filling channel continuously connected to the low pressure return circuit and opening into the first chamber of the control device. The end of the filling channel, opening into the first chamber of the control device, may for example be arranged to be closed by the slide of the control device when the slide is in its second position.

According to a second alternative embodiment of the invention, the percussion device comprises a second connecting channel opening, on one hand, into the first chamber of the control device and, on the other hand, outside the percussion device.

According to this second alternative embodiment of the invention, the slide and the cylinder of the control device further preferably delimit an annular chamber connected to the low-pressure return circuit.

According to this second alternative embodiment of the invention, the slide may comprise a passage opening respectively into the first and second chambers of the control device.

According to one embodiment of the invention, the control device further comprises a first connecting channel connected to the first control channel, a second connecting channel connected to the second control channel, and a distributing member movable between a first position in which the distributing member puts the first and second connecting channels in communication, and a second position in which the distributing member isolates the first and second connecting channels.

Advantageously, at least one of the calibrated orifices of the percussion device is formed by a nozzle. Preferably, the calibrated orifice of the first connecting channel is formed by a nozzle.

According to one embodiment of the invention, the percussion device comprises a brake chamber disposed in the extension of the lower chamber, and likely to be closed by a shoulder of the piston when the striking piston exceeds its theoretical striking position.

BRIEF DESCRIPTION OF THE DRAWINGS

In any case, the invention will be better understood thanks to the following description with reference to the appended schematic drawing representing, by way of non-limiting examples, a number of embodiments of this percussion device.

DETAILED DESCRIPTION OF VARIOUS EMBODIMENTS

Figure 2:
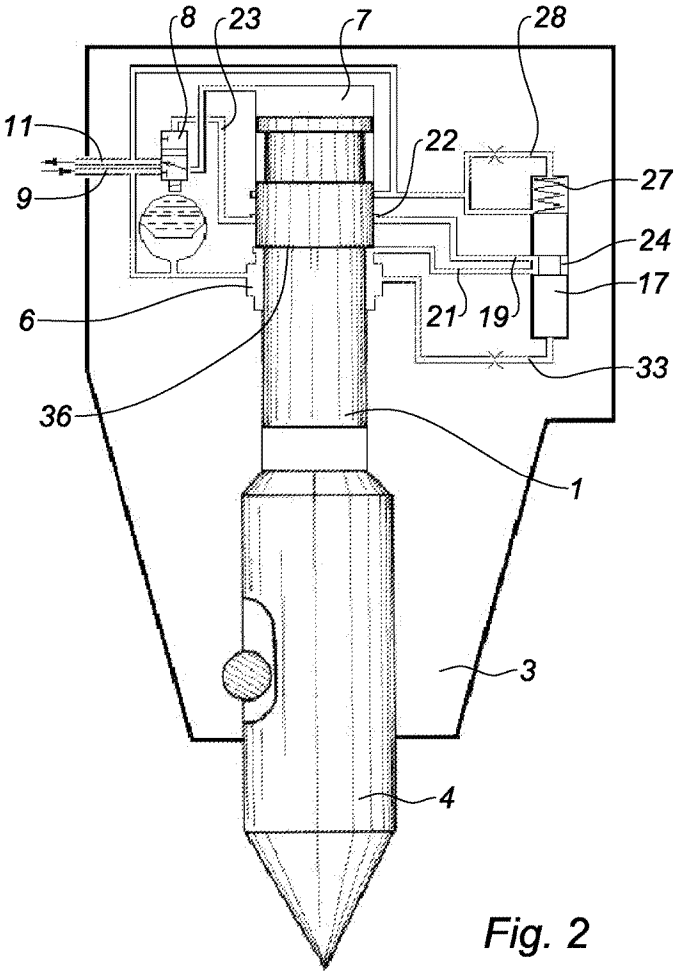
FIGS. 1 to 3 are longitudinal section views of a hydraulic device according to a first embodiment of the invention in different operating positions.
Figure 1:
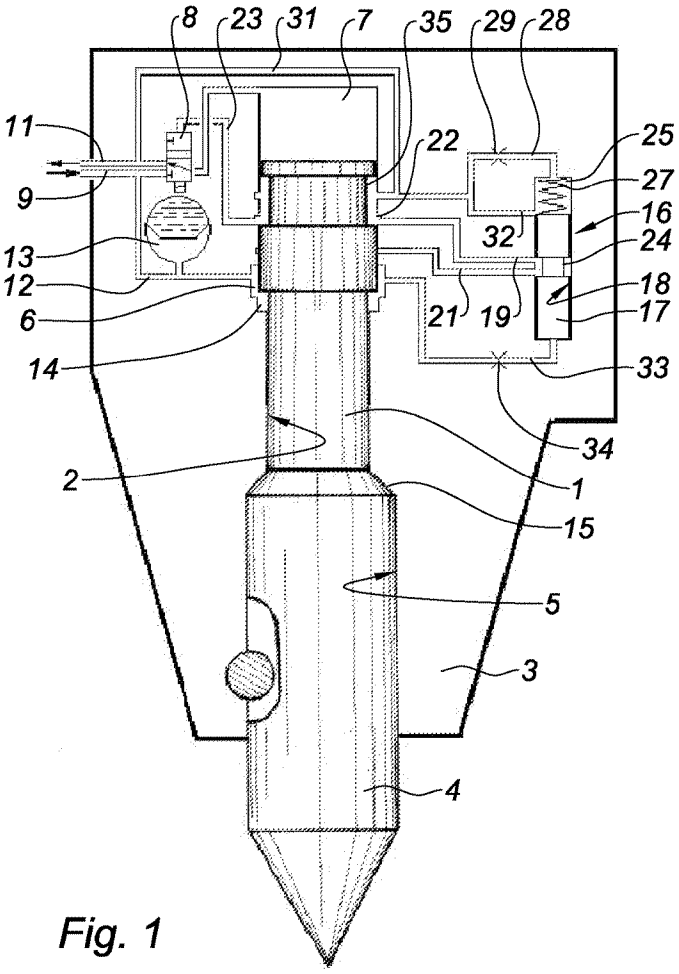
Figure 3:
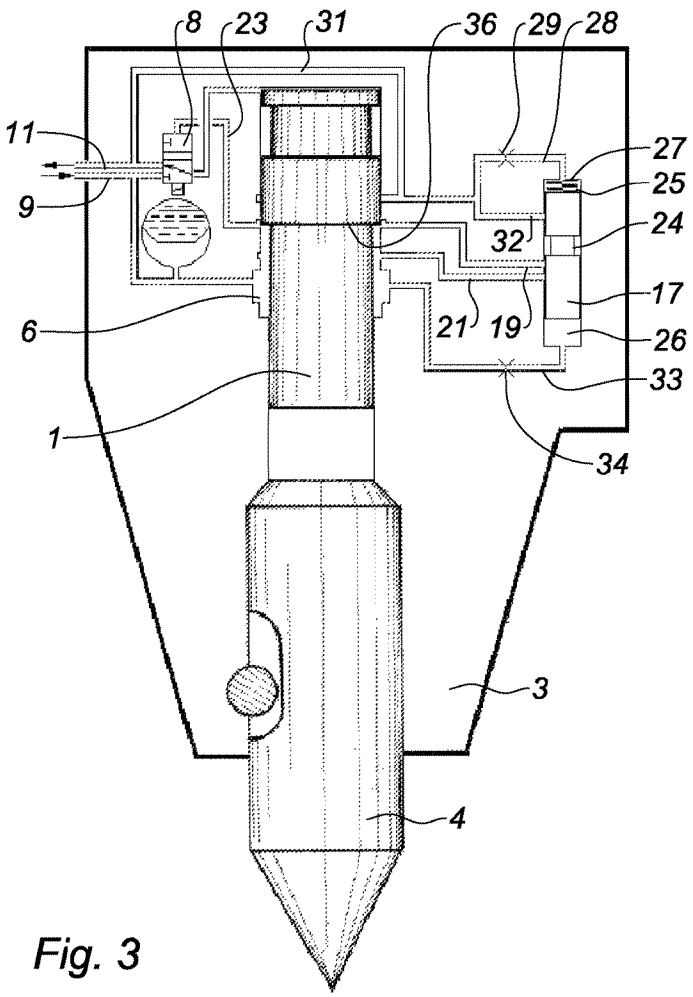

The hydraulic percussion device shown in FIGS. 1 to 3 comprises a stepped striking piston 1 mounted to slide alternately inside a cylinder 2 arranged in a body 3 of the device. During each operating cycle, the striking piston 1 is intended to strike the upper end of a tool 4 mounted to slide in a bore 5 arranged in the body 3 coaxially with the cylinder 2.

The striking piston 1 and the cylinder 2 delimit an annular lower chamber 6 and an upper chamber 7 of larger section arranged above the striking piston 1.

The percussion device further comprises a main distributor 8 mounted into the body 3 arranged to put the upper chamber 7 in relation alternately with a high pressure fluid supply circuit 9 during the striking stroke of the striking piston 1, or with a low pressure return circuit 11 during the upstroke of the striking piston 1, as shown in FIG. 1. The lower chamber 6 is continuously supplied with high-pressure fluid via a channel 12, so as each position of the distributor 8 causes the striking stroke of the striking piston 1, then the upstroke. Advantageously, the channel 12 may be connected to an accumulator 13.

The striking piston 1 also delimits with the cylinder 2, an annular chamber 14, called brake chamber, arranged in the extension of the lower chamber 6 and supplied with high-pressure fluid by the latter. The brake chamber allows, by the dashpot principle, to dissipate the striking energy of the striking piston 1 when the tool 4 is not close to its theoretical operating position, that is to say, pressed on the conical portion 15 of the body 3.

The percussion device further comprises a control device 16 arranged to vary the striking stroke of the striking piston 1 between a short striking stroke and a long striking stroke and conversely. The control device 16 comprises a slide 17 mounted in a cylinder 18 arranged in the body 3 and into which two axially offset control channels 19 and 21 open, these opening also into the cylinder 2 of the striking piston 1. The control channel 19 is connected to a control section of the main distributor 8 via an annular groove 22 and a channel 23. The control channel 21 opens into the cylinder 2 between the lower chamber 6 and the control channel 19, and is used to control the short striking stroke of the striking piston 1. The control channel 21 is particularly arranged to be put in communication with the lower chamber 6 during the upstroke of the striking piston 1, as shown in FIG. 2.

The slide 17 comprises a groove 24 and is movable between a first position (shown in FIG. 1) in which the groove 24 puts the control channels 19, 21 in communication, and a second position (shown in FIG. 3) in which the groove 24 isolates the control channels 19, 21.

The slide 17 and the cylinder 18 of the control device 16 delimit a first chamber 25 in which a first face of the slide 17 is situated, and a second chamber 26 in which a second face of the slide 17, opposite the first face, is situated.

The first chamber 25 houses a return spring 27 arranged to cooperate with the first face of the slide 17 so as to bias the latter to its first position. The first chamber 25 is continuously connected to the low-pressure return circuit 11 by a first connecting channel 28 provided with a calibrated orifice 29, and a second connecting channel 31 also opening into the cylinder 2 of the striking piston. The first connecting channel 28 opens advantageously into a first end wall of the cylinder 18. The percussion device preferably comprises also a filling channel 32 continuously connected to the low-pressure return circuit 11 via the connecting channel 31 and opening into the first chamber 25 of the control device. As shown in FIG. 3, the end of the filling channel 32 opening into the first chamber 25 of the control device is arranged to be closed by the slide 17 when the latter is in its second position, and to be released when the slide is in its first position.

The second chamber 26 is connected to the lower chamber 6 via a connecting channel 33 provided with a calibrated orifice 34. The connecting channel 33 opens, on one hand, into the second chamber 26 and, on the other hand, into a second end wall of the cylinder 18 of the control device.

The striking piston 1 includes an annular groove 35 in its upper part, and allows, when it is pressed on the tool 4, to establish communication between the low-pressure return circuit 11 and the channel 23 via the channel 31 and the annular groove 35.

For the following description, it is assumed, by way of example, that the distributor 8 is driven by an upward movement when the channel 23 is connected to the low-pressure return circuit 11, and by a downward movement when the channel 23 is connected to the high-pressure fluid supply circuit 9. Thus, the channel 23 allows to control the movements of the distributor 8.

The operation of the percussion device will now be described, considering that the initial state of the latter is the one represented in FIG. 1, in which the distributor 8 is in an upper position and the striking piston 1 is in a lower position.

At start-up of the percussion device, pressurized fluid flows through the high-pressure fluid supply circuit 9, and supplies the lower chamber 6 and the second chamber 26 via the connecting channel 33. The resultant of the forces applied to the striking piston 1 then moves it upward, since the upper chamber 7 is connected to the low-pressure return circuit 11. The slide 17 is, however, maintained into its first position shown in FIG. 1, by the action of the spring 27 and due to the presence of the calibrated orifice 34.

During the upstroke of the striking piston 1, once a lower ridge 36 of the striking piston 1 reaches the outlet of the control channel 21 (see FIG. 2), high pressure, present in the lower chamber 6, is also established in the control channel 21, which is connected to the channel 23 via the annular groove 24, the control channel 19 and the annular groove 22.

The distributor 8 is then moved downward, which causes the upper chamber 7 to be put in communication with the high-pressure fluid supply circuit 9. The resultant of the hydraulic forces applied on the striking piston causes the upstroke of the striking piston to stop and the striking piston to accelerate for a short striking stroke.

When the striking piston 1 strikes the tool 4, the annular groove 35 of the striking piston 1 puts the channel 23 in communication with the low-pressure return circuit 11 via the channel 31. The distributor 8 is then moved upward (see FIG. 1), which causes the upper chamber 7 to be put in communication with the low pressure return circuit 11. The resultant of the hydraulic forces applied on the striking piston 1 causes then a upstroke of the latter.

At the expiry of a predetermined period of time, for example in the order of few seconds, the amount of fluid passing through the calibrated orifice 34 is sufficient to move the slide 17 in its second position against the action of spring 27. During this movement of the slide 17, the oil present in the first chamber 25 is evacuated toward the low-pressure return circuit 11 via the connecting channel 28 and the calibrated orifice 29. This movement of the slide 17 also causes the isolation of the control channels 19, 21, as shown in FIG. 3.

Thus, the striking piston 1 must therefore necessarily move upward until the ridge 36 reaches the position of the annular groove 22 so that the high pressure, present in the lower chamber 6, is also established in the channel 23, and causes the distributor 8 to move to its lower position so as to put the upper chamber 7 in relation with the supply circuit 9. In a known manner, the accumulator 12 maintains high pressure in the upper chamber 7 during this abrupt acceleration of the striking piston 1.

As long as the percussion device remains in operation, significant pressure is maintained in the second chamber 26, and the slide 17 is in fact also maintained in its second position. As a consequence, the isolation of the control channels 19, 21 allows to control the operation of the percussion device according to the long striking stroke of the striking piston 1.

It should be noted that the predetermined period of time for allowing the slide 17 to move from its first position to its second position can be adjusted, for example, by adjusting the diameters of the calibrated orifices 29, 34.

When the percussion device stops, the lower chamber 6, the connecting channel 33 and the second chamber 26 in particular decompress. The slide 17 is then biased to its first position by the spring 27, which ensures communication between the control channels 19, 21 at the next start-up of the percussion device, and therefore operation of the percussion device according to the short striking stroke of the striking piston 1 during the predetermined period of time. The filling channel 32 ensures for its part that the first chamber 25, in which the spring 27 is located, is filled with fluid.

Figure 4:
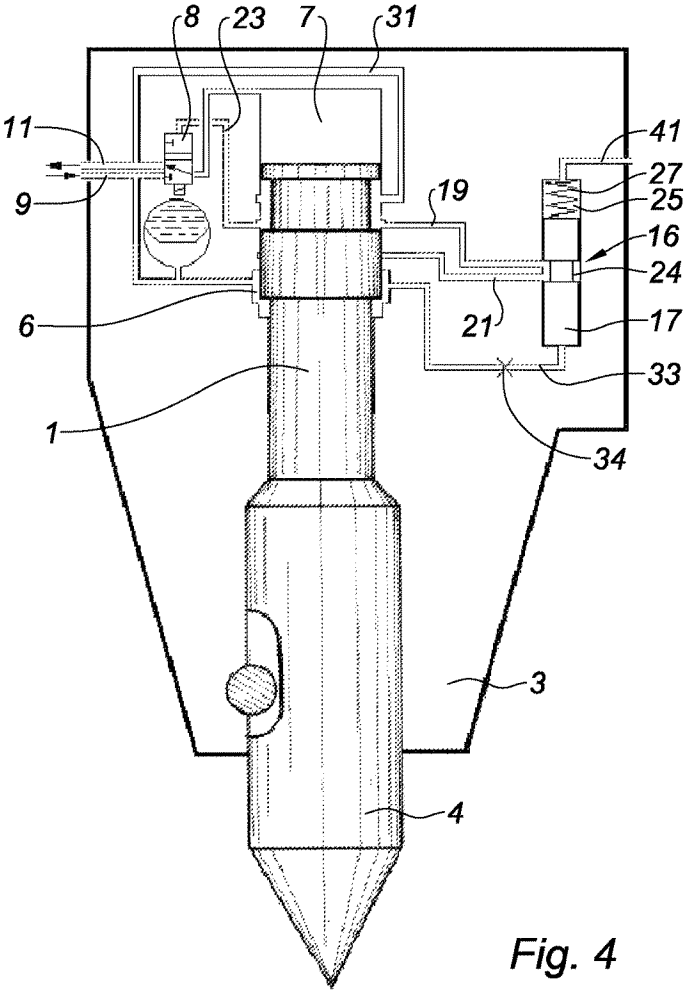
FIGS. 4 to 6 are longitudinal section views of a hydraulic device according to a second embodiment of the invention in different operating positions.
Figure 6:
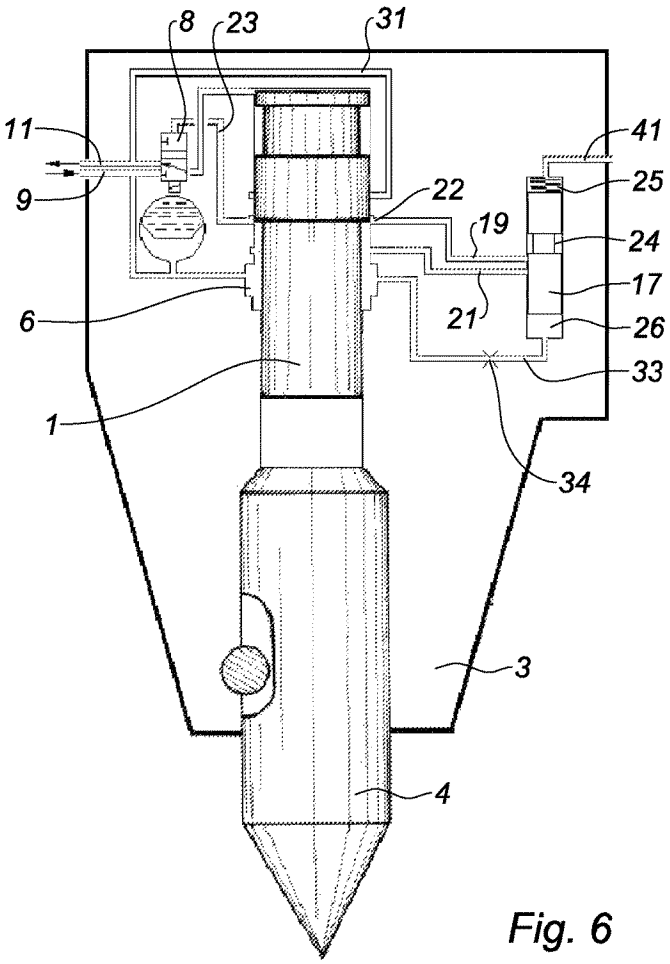
Figure 5:
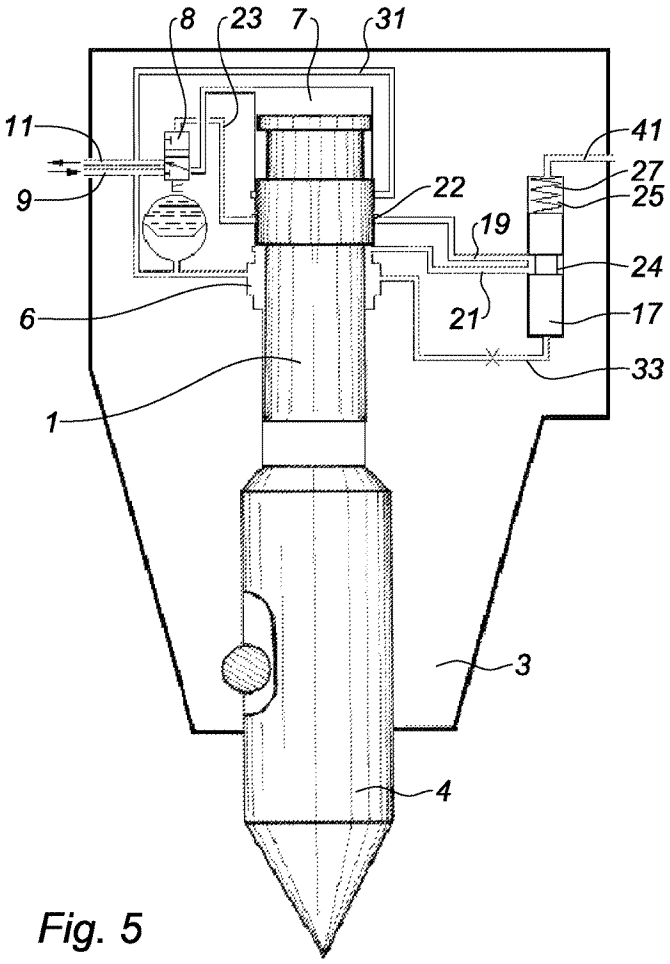

FIGS. 4 to 6 shows a percussion device according to a second embodiment of the invention which differs from the one shown in FIGS. 1 to 3 primarily in that the first chamber 25 is connected to free air via a connecting channel 41 opening, on one hand, into the first chamber 25 and on the other hand, outside the of the body 3 of the percussion device.

The percussion device according this second embodiment operates in substantially the same manner as the one shown in FIGS. 1 to 3. At startup, as shown in FIG. 4, the slide 17, pushed by the spring 27, is in its first position in which the annular groove 24 connects the control channels 19, 21. For a few seconds, the percussion device then operates on a short striking stroke, as shown in FIG. 5. After these few seconds, as shown in FIG. 6, the pressurized fluid, in the connecting channel 33, passes through the calibrated orifice 34 and gradually pushes back the slide 17 against the action of the spring 27. In the same manner as above, this causes the striking piston 1 to operate on a long striking stroke of the striking piston 1 until supply to the percussion device is interrupted. It should be noted that emptying and filling the first chamber 25, allowing the last slide 17 to move between its first and second positions are performed via the connecting channel 41.

Figure 8:
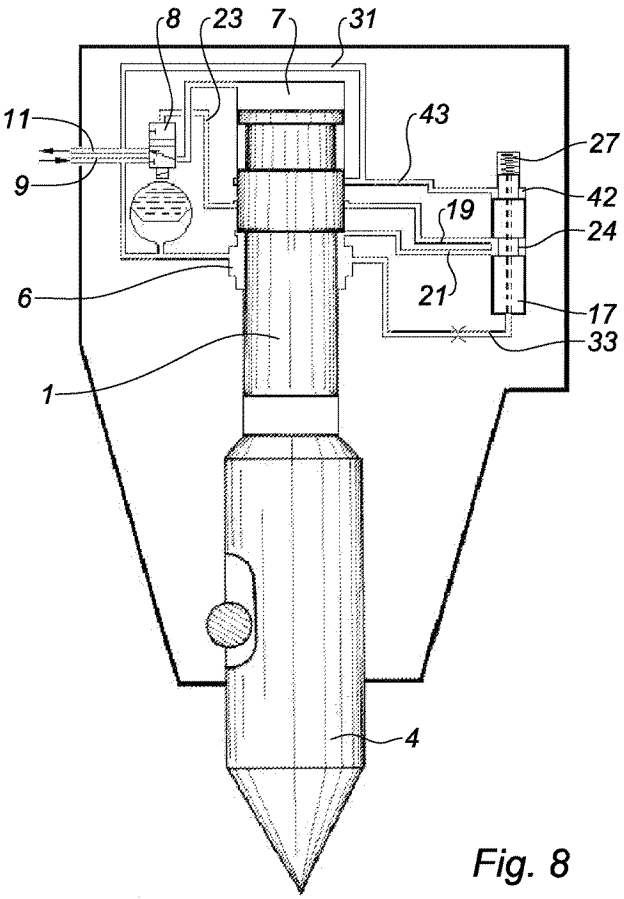
FIGS. 7 to 9 are longitudinal section views of a hydraulic device according to a third embodiment of the invention in different operating positions.
Figure 7:
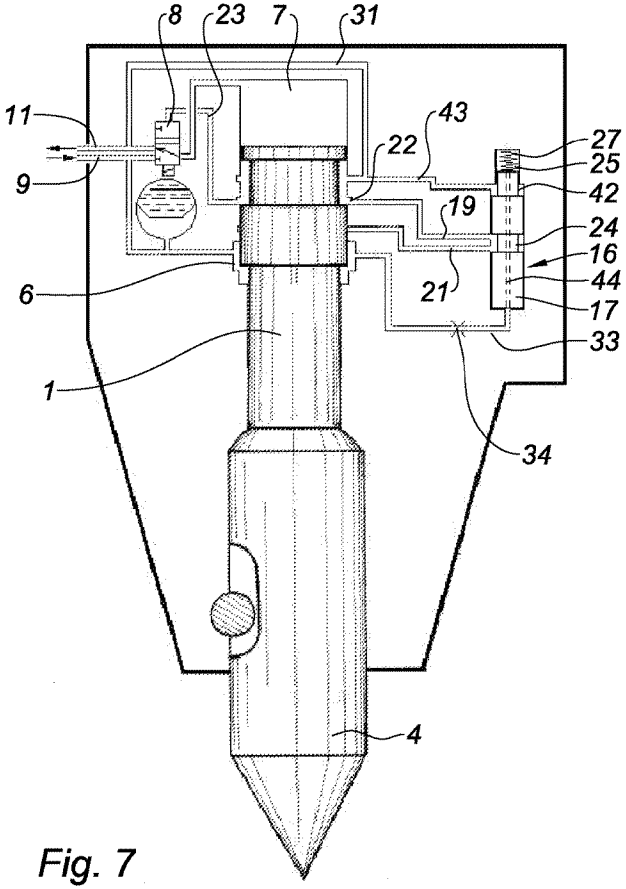
Figure 9:
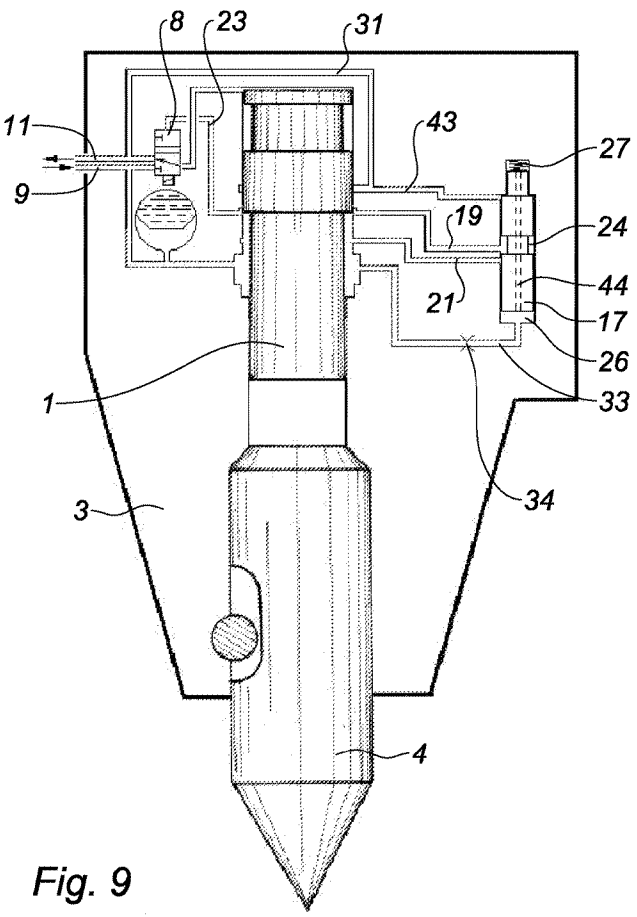

FIGS. 7 to 9 show a percussion device according to a third embodiment of the invention which differs from the one shown in FIGS. 1 to 3 primarily in that the slide 17 and the cylinder 18 of the control device also delimit an annular chamber 42 connected to the low-pressure return circuit 11 via the connecting channel 43 and the connecting channel 31, and in that the slide comprises a longitudinal passage 44 opening respectively into the first and second chambers 25, 26 of the control device.

The percussion device according to this third embodiment operates substantially in the same manner as the one shown in FIGS. 1 to 3. As shown in FIG. 8, the slide 17 remains for a predetermined period of time in its first position in which the annular groove 24 of the slide 17 connects the control channels 19, 21 for an operation on a short striking stroke of the striking piston 1. At the expiry of the predetermined period of time, the pressurized fluid in the connecting channel 33, passes through the calibrated orifice 34, and gradually pushes back the slide 17 to its second position, against the action of the spring 27. During the movement of the slide 17, the annular chamber 42 remains connected to the low-pressure return circuit 11, and the fluid contained in the first chamber 25 flows back, via the longitudinal passage 44, to the second chamber 26.

Figure 10:
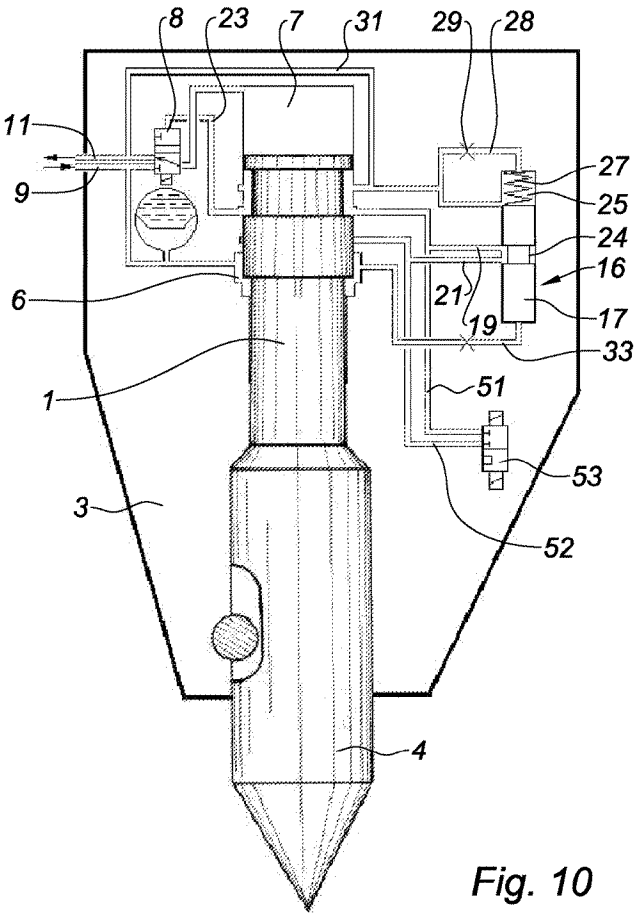
FIG. 10 is a longitudinal section view of a hydraulic device according to a fourth embodiment of the invention.

FIG. 10 shows a percussion device according to a fourth embodiment of the invention which differs from the one shown in FIGS. 1 to 3 primarily in that the control device further comprises a connecting channel 51 connected to the control channel 19, a connecting channel 52 connected to the control channel 21, and a distributing member 53 movable between a first position in which the distributing member 53 puts the connecting channels 51, 52 in communication, and a second position in which the distributing member 53 isolates the connecting channels 51, 52.

The distributing member 53 is particularly arranged to be moved between its first and second positions depending on the hardness of the material to be demolished. The percussion device comprises, for example, control means arranged to control the movements of the distributing member 53 between its first and second positions.

At start-up, the slide 17 is, as previously, in its first position in which the annular groove 24 of the slide 17 connects the control channels 19, 21 for an operation on a short striking stroke of the striking piston 1. Then, at the expiry of a predetermined period of time, by adjusting the calibrated orifice 34, the slide 17 moves into its second position and cuts off communication between the control channels 19, 21. The percussion device can then operate on a short or long striking stroke depending on the hardness of the material to be demolished, and more particularly on the position of the distributing member.

It goes without saying that the invention is not limited to the only embodiments of this percussion device, described above by way of examples, and, on the contrary, it encompasses all alternative embodiments.

The invention claimed is:

1. A method for switching the striking stroke of a striking piston of a percussion device, actuated by a pressurized incompressible fluid, between a short striking stroke and a long striking stroke, and conversely, the striking piston being alternately movable inside a cylinder of a body of the percussion device and being arranged to strike a tool during each operating cycle, the percussion device comprising a control device arranged to vary the striking stroke of the striking piston between the short and long striking strokes, the switching method being wherein it comprises the steps of:

starting up the percussion device;

acting on the control device so as force the percussion device to operate on a short striking stroke for a predetermined period of time from the starting up of the device; and acting on the control device so as to allow the percussion device to operate on a long striking stroke, after the expiry of the predetermined period of time;

wherein the striking piston and the cylinder delimit at least a lower chamber connected continuously to a high-pressure fluid supply circuit and an upper chamber put in relation alternately with the high-pressure fluid supply circuit and a low-pressure return circuit by the action of a distributor connected to the control device, and wherein the control device comprises a first control channel connected to the distributor, and a second control channel opening into the cylinder of the striking piston and arranged to be put in communication with the lower chamber during the upstroke of the striking piston, the step of acting on the control device performed for the predetermined period of time consisting in acting on the control device so as to maintain communication between the first and second control channels, and the step of acting on the control device performed at the expiry of the predetermined period of time consisting in acting on the control device so as to isolate the first and second control channels; and wherein the step of acting on the control device performed after the expiry the predetermined period of time comprises a step of supplying the control device with high-pressure fluid via a connecting channel provided with a calibrated orifice, so as to move a slide which the control device includes.

2. A percussion device actuated by a pressurized incompressible fluid, including:

a striking piston mounted to alternately move inside a cylinder arranged in a body of the percussion device, and arranged to strike a tool during each operating cycle of the percussion device, the striking piston and the cylinder delimiting a lower chamber connected continuously to a high-pressure fluid supply circuit and an upper chamber;

a distributor arranged to put the upper chamber in relation alternately with the high-pressure fluid supply circuit and a low-pressure return circuit;

a control device arranged to vary the striking stroke of the striking piston between a short striking stroke and a long striking stroke, and conversely, the control device comprising a cylinder, a first control channel opening into the cylinder of the control device and connected to the distributor, and a second control channel opening into the cylinder of the control device and the cylinder of the striking piston, the second control channel being arranged to be put in communication with the lower chamber during the upstroke of the striking piston, the control device further comprising a slide mounted to move inside the cylinder of the control device between a first position in which the slide puts the first and second control channels in communication, and a second position in which the slide isolates the first and second control channels, the slide and the cylinder of the control device delimiting at least a first chamber in which a first face of the slide is situated, and a second chamber in which a second face of the slide, opposite the first face, is situated;

wherein the percussion device comprises:

return means arranged to cooperate with the first face of the slide of the control device so as to bias the slide to its first position; and a first connecting channel arranged to connect the second chamber of the control device to the high-pressure fluid supply circuit, the first connecting channel being provided with a calibrated orifice.

3. The percussion device according to claim 2, wherein the first connecting channel is arranged to connect the second chamber of the control device to the lower chamber.

4. The percussion device according to claim 3, wherein the first connecting channel opens into the lower chamber and into the second chamber of the control device.

5. The percussion device according to claim 2, wherein the slide of the control device comprises an annular groove arranged to put the first and second channels in communication when the slide is in its first position.

6. The percussion device according to claim 2, wherein the first control channel also opens into the cylinder of the striking piston, and the second control channel opens into the cylinder of the striking piston between the first control channel and the lower chamber.

7. The percussion device according to claim 2, further comprising a second connecting channel provided with a calibrated orifice, the second connecting channel being connected continuously to the low-pressure return circuit and opening into the first chamber of the control device.

8. The percussion device according to claim 7, further comprising a filling channel continuously connected to the low-pressure return circuit and opening into the first chamber of the control device.

9. The percussion device according to claim 8, wherein the end of the filling channel, opening into the first chamber of the control device, is arranged to be closed by the slide of the control device when the slide is in its second position.

10. The percussion device according to claim 2, further comprising a second connecting channel opening into the first chamber of the control device and outside the percussion device.

11. The percussion device according to claim 2, wherein the slide and the cylinder of the control device also delimit an annular chamber connected to the low-pressure return circuit.

12. The percussion device according to claim 11, wherein the slide comprises a passage opening respectively into the first and second chambers of the control device.

13. The percussion device according to claim 2, wherein the control device further comprises a first connecting channel connected to the first control channel, a second connecting channel connected to the second control channel, and a distributing member movable between a first position in which the distributing member puts the first and second connecting channels in communication, and a second position in which the distributing member isolates the first and second connecting channels.

* * * * *